US009500974B2

(12) United States Patent
Tamagaki et al.

(10) Patent No.: US 9,500,974 B2
(45) **Date of Patent: *Nov. 22, 2016**

(54) TONER

(71) Applicant: KYOCERA Document Solutions Inc., Osaka (JP)

(72) Inventors: Masashi Tamagaki, Osaka (JP); Tomoyuki Ogawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/807,409

(22) Filed: Jul. 23, 2015

(65) Prior Publication Data

US 2016/0033888 A1 Feb. 4, 2016

(30) Foreign Application Priority Data

Jul. 30, 2014 (JP) ..... 2014-155005

(51) Int. Cl.
*G03G 9/093* (2006.01)
*G03G 9/08* (2006.01)

(52) U.S. Cl.
CPC ..... *G03G 9/09321* (2013.01); *G03G 9/0819* (2013.01)

(58) Field of Classification Search
CPC ..... G03G 9/09321; G03G 9/09328; G03G 9/09307
See application file for complete search history.

(56) References Cited

U.S. PATENT DOCUMENTS

| | | | | |
|---|---|---|---|---|
| 3,330,810 | A * | 7/1967 | Von Bonin | C08F 8/30 525/329.2 |
| 9,304,426 | B2 * | 4/2016 | Ozawa | G03G 9/09328 |
| 9,329,509 | B2 * | 5/2016 | Ozawa | G03G 9/09392 |
| 2005/0271964 | A1 | 12/2005 | Etou et al. | |
| 2008/0160441 | A1 * | 7/2008 | Kim | G03G 9/09321 430/109.3 |

FOREIGN PATENT DOCUMENTS

| | | | |
|---|---|---|---|
| JP | 11-295917 | A | 10/1999 |
| JP | 2003-107779 | A | 4/2003 |
| JP | 2004-294467 | A | 10/2004 |
| JP | 2007-171272 | A | 7/2007 |
| JP | 2014-048341 | A | 3/2014 |

* cited by examiner

*Primary Examiner* — Hoa V Le
(74) *Attorney, Agent, or Firm* — Studebaker & Brackett PC

(57) ABSTRACT

A toner includes a plurality of toner particles each including a core and a shell layer disposed over a surface of the core. The shell layers include a resin containing a unit derived from a thermoplastic resin and a unit derived from a monomer or prepolymer of a thermosetting resin. The toner has an average roundness of no less than 0.965 and no greater than 0.975. The toner contains less than 0.5% by number of toner particles having a roundness of no greater than 0.85. The toner has a displacement rate of no less than 0.50% and no greater than 0.70% as measured in a micro-compression test that is performed on the toner under specified conditions.

6 Claims, No Drawings

TONER

INCORPORATION BY REFERENCE

The present application claims priority under 35 U.S.C. §119 to Japanese Patent Application No. 2014-155005, filed Jul. 30, 2014. The contents of this application are incorporated herein by reference in their entirety.

BACKGROUND

The present disclosure relates to a toner. More particularly, the present disclosure relates to a capsule toner.

Toner particles contained in a capsule toner each have a core and a shell layer (capsule layer) disposed over a surface of the core. For example, a known technique improves low-temperature fixability and preservability of a toner by limiting the average volume diameter and the average roundness of pigmented resin particles, and the average fracture strength of the toner.

SUMMARY

A toner according to the present disclosure includes a plurality of toner particles each including a core and a shell layer disposed over a surface of the core. The shell layers include a resin containing a unit derived from a thermoplastic resin and a unit derived from a monomer or prepolymer of a thermosetting resin. The toner has an average roundness of no less than 0.965 and no greater than 0.975. The toner contains less than 0.5% by number of toner particles having a roundness of no greater than 0.85. The toner has a displacement rate represented by the equation "toner displacement rate=100×Z1/Z2" of no less than 0.50% and no greater than 0.70% as measured in a micro-compression test on the toner, where: Z1 is an amount of displacement of the toner particles when subjected to load at a load rate of 60 nN/s until the load reaches a maximum load of 60 nN, and then left to stand for one second at the maximum load in an environment at a temperature of 23° C. and a relative humidity of 50%; and Z2 is a particle size of the toner particles.

DETAILED DESCRIPTION

Hereinafter, an embodiment of the present disclosure will be described. Note that unless otherwise stated, results (e.g., values indicating shapes or properties) of evaluations that are performed on a powder (more specifically, cores, toner mother particles, an external additive, or a toner) are number averages of measurements made with respect to an appropriate number of particles. Also note that in the present description the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. In the present description, the term "(meth) acryl" is used as a generic term for both acryl and methacryl.

A toner according to the present embodiment can be used for development of an electrostatic latent image. The toner according to the present embodiment is a powder of a large number of particles (hereinafter, referred to as toner particles). The toner according to the present embodiment can be used for example in an electrophotographic apparatus (image forming apparatus). Hereinafter, an example of a process of image formation by the electrophotographic apparatus will be described.

First, an electrostatic latent image is formed on a photosensitive member (e.g., on a surface of a photosensitive drum) based on image data. Next, the electrostatic latent image that is formed is developed using a developer that contains a toner. In the developing step, charged toner is caused to adhere to the electrostatic latent image such that a toner image is formed on the photosensitive member. The toner image on the photosensitive member is transferred onto an intermediate transfer member (e.g., a transfer belt) in a subsequent transfer step, and then the toner image on the intermediate transfer member is transferred onto a recording medium (e.g., paper). Thereafter, the toner is fixed to the recording medium by heating the toner. As a result, an image is formed on the recording medium. A full-color image can for example be formed by superimposing toner images of four colors: black, yellow, magenta, and cyan.

Toner particles contained in the toner of the present embodiment each have a core and a shell layer (capsule layer) disposed over a surface of the core. An external additive may be attached to surfaces of the cores or of the shell layers. A plurality of shell layers may be disposed over the surface of each core. The external additive may be omitted if unnecessary. Hereinafter, toner particles that are yet to be subjected to addition of an external additive are referred to as toner mother particles.

The toner according to the present embodiment satisfies the following conditions (1)-(4).

(1) The shell layers include a resin containing a unit derived from a thermoplastic resin and a unit derived from a monomer or prepolymer of a thermosetting resin. It should be noted that the term "monomer of a thermosetting resin" refers to a monomer that forms a thermosetting resin through homopolymerization. For example, when molecules of a single monomer are connected together via "—$CH_2$—" to form a thermosetting resin, the monomer is considered to be a "monomer of a thermosetting resin". The term "prepolymer of a thermosetting resin" refers to a prepolymer that is formed through homopolymerization of a monomer of a thermosetting resin.

(2) The toner has an average roundness of no less than 0.965 and no greater than 0.975.

(3) The toner contains less than 0.5% by number of toner particles having a roundness of no greater than 0.85.

(4) The toner has a displacement rate represented by the equation "toner displacement rate=100×Z1/Z2" of no less than 0.50% and no greater than 0.70% as measured in a micro-compression test on the toner, wherein: Z1 is an amount of displacement of the toner particles when subjected to load at a load rate of 60 nN/s until the load reaches a maximum load of 60 nN, and then left to stand for one second at the maximum load in an environment at a temperature of 23° C. and a relative humidity of 50%; and Z2 is a particle size of the toner particles. Note that the Z2 corresponds to a sphere-equivalent diameter of the toner particles. It is thought that varying the temperature within the range of from 22° C. to 24° C. and varying the relative humidity within the range of from 40% to 60% with respect to the test environment hardly affect the resulting toner displacement rate.

The condition (1) is effective for improving both high-temperature preservability and fixability of the toner. More specifically, the unit derived from a thermoplastic resin is expected to contribute to the improvement in the fixability (in particular, low-temperature fixability) of the toner, and the unit derived from a monomer or prepolymer of a thermosetting resin is expected to contribute to the improvement in the high-temperature preservability of the toner.

The conditions (2) and (3) are effective for improving blade cleaning ability of the toner. More specifically, cores or toner mother particles may form conjugates (irregular-shaped particles) during formation of shell layers on surfaces of cores. The inventors have found that a toner having a sufficiently high average roundness but including a large number of irregular-shaped particles has poor blade cleaning ability. The inventors have also found that a toner having excellent blade cleaning ability can be obtained by limiting the average roundness of the toner and the amount of irregular-shaped particles (toner particles having a roundness of no greater than 0.85) in the toner as specified above (see Tables 1 and 2 to be mentioned later). It is considered particularly preferable that a toner whose shell layers include a resin containing a unit derived from an acrylic acid-based resin and a unit derived from a monomer or prepolymer of a urea-based resin has an average roundness of no less than 0.965 and no greater than 0.970 in order that the toner has improved high-temperature preservability. It is also considered preferable that the toner contains no greater than 0.3% by number of toner particles having a roundness of no greater than 0.85 in order that the toner has improved high-temperature preservability. More preferably, the amount is no greater than 0.2% by number.

The condition (4) is effective for improving the low-temperature fixability and the blade cleaning ability of the toner. More specifically, the inventors have found that the toner displacement rate, and the low-temperature fixability and the blade cleaning ability of the toner have a certain relationship (see Tables 1 and 2 to be mentioned later).

In a configuration of the toner according to the present embodiment in which cores are anionic and a material of shell layers (hereinafter, referred to as a shell material) is cationic, the cationic shell material can be attracted to the surfaces of the cores in the shell layer formation. More specifically, it is expected that for example the shell material positively charged in an aqueous medium is electrically attracted to the cores negatively charged in the aqueous medium, and shell layers are formed over the surfaces of the cores for example through an in-situ polymerization. As a consequence of the shell material being attracted to the cores, it is expected that the shell layers can be readily formed in a uniform manner over the surfaces of the cores without using a surfactant (or with a small amount of surfactant). In addition, particle aggregation in a liquid is prevented since particles having the same polarity repel from one another.

Hereinafter, the cores (a binder resin and an internal additive), the shell layers, and the external additive will be described in order. Non-essential components (e.g., a colorant, a releasing agent, a charge control agent, and a magnetic powder) may be omitted in accordance with the intended use of the toner.

[Cores]

The cores of the toner particles contain a binder resin. The cores of the toner particles may further contain an internal additive (e.g., a colorant, a releasing agent, a charge control agent, and a magnetic powder).

(Binder Resin in Cores)

Typically, the binder resin constitutes a large proportion (e.g., no less than 85% by mass) of components of the cores of the toner particles. Properties of the binder resin are therefore expected to have great influence on an overall property of the cores. For example, in a configuration in which the binder resin has an ester group, a hydroxyl group, an ether group, an acid group, or a methyl group, the cores are highly likely to be anionic. In a configuration in which the binder resin has an amino group or an amide group, the cores are highly likely to be cationic. In order that the binder resin is strongly anionic, the binder resin preferably has a hydroxyl value (measured according to Japanese Industrial Standard (JIS) K-0070-1992) and an acid value (measured according to JIS K-0070-1992) that are each no less than 10 mg KOH/g, and more preferably no less than 20 mg KOH/g.

The binder resin preferably has one or more chemical group selected from the group consisting of an ester group, a hydroxyl group, an ether group, an acid group, and a methyl group. More preferably, the binder resin has a hydroxyl group and/or a carboxyl group. The binder resin having such a functional group readily reacts with and chemically binds to the shell material (e.g., methylol melamine) Such chemical binding causes strong binding between the cores and the shell layers. Furthermore, the binder resin preferably has an activated hydrogen-containing functional group in molecules thereof.

The glass transition point (Tg) of the binder resin is preferably no greater than a curing initiation temperature of the shell material. The use of the binder resin having such a Tg is expected to reduce deterioration of the fixability of the toner even during high speed fixing.

Tg of the binder resin can for example be measured using a differential scanning calorimeter. More specifically, Tg of the binder resin can be measured by plotting a heat absorption curve of a sample (the binder resin) using a differential scanning calorimeter ("DSC-6220", product of Seiko Instruments Inc.) and determining Tg from a point of change in specific heat on the heat absorption curve.

The softening point (Tm) of the binder resin is preferably no greater than 100° C., and more preferably no greater than 95° C. The use of the binder resin having a Tm of no greater than 100° C. (more preferably no greater than 95° C.) reduces deterioration of the fixability of the toner even during the high speed fixing. Furthermore, the use of the binder resin having a Tm of no greater than 100° C. (more preferably no greater than 95° C.) encourages the cores to partially soften during a curing reaction of the shell layers in the formation of the shell layers over the surfaces of the cores in an aqueous medium, thereby causing spheroidizing due to surface tension. Tm of the binder resin can be adjusted by combining a plurality of resins each having a different Tm.

Tm of the binder resin can for example be measured by using a capillary rheometer. More specifically, a sample (the binder resin) is placed in a capillary rheometer ("CFT-500D", product of Shimadzu Corporation) and melt-flow of the binder resin is caused under specific conditions. Then an S-shaped curve of the binder resin (horizontal axis: temperature, vertical axis: stroke) is plotted. Tm of the binder resin can be read from the S-shaped curve that is obtained. Tm of the measurement sample (the binder resin) is a temperature on the S-shaped curve corresponding to a stroke value of $(S_1+S_2)/2$, where $S_1$ represents a maximum stroke value and $S_2$ represents a base line stroke value at low temperatures.

Preferably, the binder resin is a thermoplastic resin. Examples of preferable thermoplastic resins usable as the binder resin include styrene-based resins, acrylic acid-based resins, olefin-based resins (more specifically, polyethylene resins and polypropylene resins), vinyl resins (more specifically, vinyl chloride resins, polyvinyl alcohol resins, vinyl ether resins, and N-vinyl resins), polyester resins, polyamide resins, urethane resins, styrene-acrylic acid-based resins, and styrene-butadiene-based resins. Of the resins listed above, styrene-acrylic acid-based resins and polyester resins are preferable in terms of improvement in dispersibility of the colorant in the core, chargeability of the toner, and fixability of the toner with respect to a recording medium.

Hereinafter, a styrene-acrylic acid-based resin that can be used as the binder resin will be described. The styrene-acrylic acid-based resin is a copolymer of one or more styrene-based monomers and one or more acrylic acid-based monomers.

Preferable examples of the styrene-based monomer include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Preferable examples of the acrylic acid-based monomer include (meth)acrylic acid, alkyl (meth)acrylates, and hydroxyalkyl (meth)acrylates. Examples of the alkyl (meth) acrylates include methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate. Examples of the hydroxyalkyl (meth)acrylates include 2-hydroxyethyl(meth)acrylate, 3-hydroxypropyl(meth)acrylate, 2-hydroxypropyl(meth) acrylate, and 4-hydroxybutyl(meth)acrylate.

A hydroxyl group can be introduced into the styrene-acrylic acid-based resin by using a monomer including a hydroxyl group (more specifically, p-hydroxystyrene, m-hydroxystyrene, a hydroxyalkyl (meth)acrylate, or the like) during preparation of the styrene-acrylic acid-based resin. The hydroxyl value of the styrene-acrylic acid-based resin which is prepared can be adjusted through adjustment of the amount of the hydroxyl group-containing monomer to use.

A carboxyl group can be introduced into the styrene-acrylic acid-based resin by using an acrylic acid-based monomer during preparation of the styrene-acrylic acid-based resin. The acid value of the styrene-acrylic acid-based resin which is prepared can be adjusted through adjustment of the amount of the acrylic acid-based monomer to use.

In a configuration in which a styrene-acrylic acid-based resin is used as the binder resin of the cores, the styrene-acrylic acid-based resin preferably has a number average molecular weight (Mn) of no less than 2,000 and no greater than 3,000 in order to improve the strength of the cores and the fixability of the toner. The styrene-acrylic acid-based resin preferably has a molecular weight distribution (a ratio Mw/Mn of mass average molecular weight (Mw) relative to number average molecular weight (Mn)) of no less than 10 and no greater than 20. Mn and Mw of the styrene-acrylic acid-based resin can be measured by gel permeation chromatography.

Hereinafter, a polyester resin that can be used as the binder resin will be described. The polyester resin can be synthesized through condensation polymerization or condensation copolymerization of a di-, tri-, or higher-hydric alcohol with a di-, tri-, or higher-basic carboxylic acid.

Examples of di-hydric alcohols that can be used in the synthesis of the polyester resin include diols and bisphenols.

Examples of preferable diols include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, polyoxyethylene bisphenol A ether, and polyoxypropylene bisphenol A ether.

Examples of preferable tri- or higher-hydric alcohols that can be used in the synthesis of the polyester resin include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable di-basic carboxylic acids that can be used in the synthesis of the polyester resin include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific example include n-butenylsuccinic acid, isobutenylsuccinic acid, n-octenylsuccinic acid, n-dodecenylsuccinic acid, and isododecenylsuccinic acid).

Examples of preferable tri- or higher-basic carboxylic acids that can be used in the synthesis of the polyester resin include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra (methylenecarboxyl)methane, 1,2,7,8-octanetetracarboxylic acid, pyromellitic acid, and EMPOL trimer acid.

Alternatively, an ester-forming derivative (more specifically, an acid halide, acid anhydride, or lower alkyl ester) of any of the di-, tri-, or higher-basic carboxylic acids listed above may be used. The term "lower alkyl" refers to an alkyl group having from one to six carbon atoms.

The acid value and the hydroxyl value of the polyester resin can be adjusted through adjustment of the amount of the alcohol and the amount of the carboxylic acid used during preparation of the polyester resin. Increasing the molecular weight of the polyester resin tends to decrease the acid value and the hydroxyl value of the polyester resin.

In a configuration in which a polyester resin is used as the binder resin of the cores, the polyester resin preferably has a number average molecular weight (Mn) of no less than 1,000 and no greater than 2,000 in order to improve the strength of the cores and the fixability of the toner. The polyester resin preferably has a molecular weight distribution (a ratio Mw/Mn of mass average molecular weight (Mw) relative to number average molecular weight (Mn)) of no less than 9 and no greater than 21. Mn and Mw of the polyester resin can be measured by gel permeation chromatography.

(Colorant in Cores)

The cores of the toner particles may contain a colorant. The colorant can be a known pigment or dye that matches the color of the toner. The amount of the colorant is preferably no less than 1 part by mass and no greater than 20 parts by mass relative to 100 parts by mass of the binder resin, and more preferably no less than 3 parts by mass and no greater than 10 parts by mass in order to form a high-quality image with the toner.

The cores of the toner particles may contain a black colorant. Examples of the black colorant include carbon black. The black colorant may be a colorant that is adjusted to a black color using a yellow colorant, a magenta colorant, and a cyan colorant.

The cores of the toner particles may contain a non-black colorant such as a yellow colorant, a magenta colorant, or a cyan colorant.

Examples of the yellow colorant include condensed azo compounds, isoindolinone compounds, anthraquinone compounds, azo metal complexes, methine compounds, and arylamide compounds. Preferable examples of the yellow colorant include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

Examples of the magenta colorant include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Preferable examples of the magenta colorant include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Examples of the cyan colorant include copper phthalocyanine compounds, anthraquinone compounds, and basic dye lake compounds. Preferable examples of the cyan colorant include C.I. Pigment Blue (1, 7, 15, 15:1, 15:2, 15:3, 15:4, 60, 62, and 66), Phthalocyanine Blue, C.I. Vat Blue, and C.I. Acid Blue.

(Releasing Agent in Cores)

The cores of the toner particles may contain a releasing agent. The releasing agent is for example used in order to improve fixability of the toner or resistance of the toner to being offset. The cores are preferably prepared using an anionic wax in order to increase the anionic strength of the cores. The amount of the releasing agent is preferably no less than 1 part by mass and no greater than 30 parts by mass relative to 100 parts by mass of the binder resin, and more preferably no less than 5 parts by mass and no greater than 20 parts by mass in order to improve the fixability or the offset resistance of the toner.

Preferable examples of the releasing agent include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as major component such as montanic acid ester wax and castor wax; and waxes in which a part or all of a fatty acid ester has been deoxidized such as deoxidized carnauba wax.

A compatibilizer may be added to the cores of the toner particles in order to improve compatibility between the binder resin and the releasing agent.

(Charge Control Agent in Cores)

The cores of the toner particles may contain a charge control agent. The charge control agent is for example used in order to improve charge stability or a charge rise characteristic of the toner. The anionic strength of the cores can be increased through the cores containing a negatively chargeable charge control agent. The charge rise characteristic of the toner is an indicator as to whether the toner can be charged to a specific charge level in a short period of time.

(Magnetic Powder in Cores)

The cores of the toner particles may contain a magnetic powder. Examples of the magnetic powder include iron (more specifically, ferrite and magnetite), ferromagnetic metals (more specifically, cobalt and nickel), compounds (more specifically, alloys) containing either or both of iron and a ferromagnetic metal, ferromagnetic alloys subjected to ferromagnetization (more specifically, heat treatment), and chromium dioxide.

The magnetic powder is preferably subjected to surface treatment in order to inhibit elution of metal ions (e.g., iron ions) from the magnetic powder. In a situation in which the shell layers are formed over the surfaces of the cores under acidic conditions, elution of metal ions to the surfaces of the cores causes the cores to adhere to one another more readily. Inhibiting elution of metal ions from the magnetic powder inhibits the cores from adhering to one another.

[Shell Layers]

The shell layers include a unit derived from a thermoplastic resin (hereinafter, referred to as a thermoplastic unit) and a unit derived from a monomer or prepolymer of a thermosetting resin (hereinafter, referred to as a thermosetting unit). In the shell layers, for example, the thermoplastic unit is cross-linked by the thermosetting unit. The shell layers such as described above are expected to have suitable flexibility due to the thermoplastic resin and suitable mechanical strength due to the three-dimensional cross-linking structure formed by the monomer or prepolymer of the thermosetting resin. Therefore, the toner including the toner particles having such shell layers has excellent properties in terms of both high-temperature preservability and low-temperature fixability. More specifically, the shell layers are not readily ruptured during storage or transport of the toner. On the other hand, during fixing of the toner, the shell layers are readily ruptured due to application of heat and pressure, and softening or melting of the cores (such as the binder resin) proceeds rapidly. Therefore, the toner can be fixed to a recording medium at low temperatures.

Note that the thermoplastic unit includes a unit that is modified (introduction of a functional group, oxidation, reduction, or substitution of atoms) without drastically changing the structure or properties of the base thermoplastic resin. The thermosetting unit includes a unit that is modified (introduction of a functional group, oxidation, reduction, or substitution of atoms) without drastically changing the structure or properties of the base monomer or prepolymer of the thermosetting resin.

Inclusion of the thermoplastic unit and the thermosetting unit in the resin in the shell layers facilitates formation of shell layers having a uniform thickness over the surfaces of the cores. The thermosetting resin is readily chargeable to a strong positive charge. If the shell layers include only the thermosetting resin, therefore, the shell layers may be charged to a too strong positive charge. Since the resin in the shell layers contain the thermoplastic unit, the charge of the toner can be easily adjusted to within a desired range. Note that the shell layers may contain a charge control agent (e.g., positively chargeable charge control agent).

In order to inhibit dissolution or elution of the cores (e.g., binder resin) during formation of the shell layers, the formation of the shell layers is preferably carried out in an aqueous medium. Therefore, the shell material is preferably water-soluble.

The ratio between the thermoplastic unit and the thermosetting unit is determined as appropriate. Examples of the ratio between the thermoplastic unit and the thermosetting unit include 1:1, 1:2, 1:3, 1:4, 1:5, 2:1, 3:1, 4:1, and 5:1 (thermoplastic unit:thermosetting unit, ratio by mass).

Preferably, the thermoplastic unit has a functional group (e.g., hydroxyl group, carboxyl group, amino group, carbodiimide group, oxazoline group, or glycidyl group) that is reactive with a functional group (e.g., methylol group or amino group) of the thermosetting unit. The amino group may be present in the thermoplastic unit in the form of a carbamoyl group (—$CONH_2$).

A unit derived from the following thermoplastic resin is preferable as the thermoplastic unit. The thermoplastic resin relating to the thermoplastic unit is preferably a water-soluble resin, and particularly preferably a water-soluble resin including a unit having a polar functional group (e.g., glycol, carboxylic acid, and maleic acid). The thermoplastic resin having a polar functional group has a high reactivity. Examples of the water-soluble thermoplastic resin include polyvinyl alcohol, polyvinylpyrrolidone, carboxymethyl cellulose (or a derivative thereof), sodium polyacrylate, polyacrylamide, polyethylenimine, and polyethylene oxide.

The thermoplastic unit preferably includes a repeating unit derived from an acrylic acid-based monomer, and more preferably a repeating unit derived from acrylic acid ester having a high reactivity. The thermoplastic unit including the repeating unit derived from the acrylic acid-based monomer is expected to readily react with the monomer or prepolymer of the thermosetting resin, thereby enabling improved film quality of the shell layers. Particularly preferably, the thermoplastic unit includes a repeating unit derived from 2HEMA (2-hydroxyethyl methacrylate).

Specific examples of the thermoplastic resin relating to the thermoplastic unit include acrylic acid-based resins, styrene-acrylic acid-based copolymers, silicone-acrylic acid-based graft copolymers, urethane resins, polyester resins, and ethylene-vinyl alcohol copolymers. The thermoplastic resin relating to the thermoplastic unit is preferably an acrylic acid-based resin, a styrene-acrylic acid-based copolymer, or a silicone-acrylic acid-based graft copolymer, of which an acrylic acid-based resin is most preferable.

Examples of the acrylic acid-based monomer that can be used to include the thermoplastic unit in the resin in the shell layers include: (meth)acrylic acid; alkyl (meth)acrylates such as methyl (meth)acrylate, ethyl (meth)acrylate, n-propyl (meth)acrylate, and n-butyl (meth)acrylate; aryl (meth) acrylates such as phenyl (meth)acrylate; hydroxyalkyl (meth)acrylates such as 2-hydroxyethyl (meth)acrylate, 3-hydroxypropyl (meth)acrylate, 2-hydroxypropyl (meth) acrylate, and 4-hydroxybutyl (meth)acrylate; (meth)acrylamide; ethylene oxide adduct of (meth)acrylic acid; and alkyl ethers (more specifically, methyl ether, ethyl ether, n-propyl ether, and n-butyl ether) of ethylene oxide adducts of (meth)acrylic acid esters.

Preferably, the thermosetting unit is a unit derived from a monomer or prepolymer of the following thermosetting resins. Preferable examples of the thermosetting resin relating to the thermosetting unit include melamine resins, urea resins, sulfonamide resins, glyoxal resins, guanamine resins, aniline resins, polyimide resins, derivatives of any of the aforementioned resins. A polyimide resin contains nitrogen atoms in a molecular backbone thereof. As a consequence, a resin including a unit derived from a monomer or prepolymer of a polyimide resin tend to be strongly cationic. Examples of the polyimide resin include maleimide-based polymers and bismaleimide-based polymers (more specifically, amino-bismaleimide copolymers and bismaleimide-triazine copolymers).

In particular, the thermosetting resin relating to the thermosetting unit is preferably a resin generated by polycondensation of an aldehyde (e.g., formaldehyde) and a compound containing an amino group (hereinafter, referred to as an amino-aldehyde resin). Note that a melamine resin is a polycondensate of melamine and formaldehyde. A urea resin is a polycondensate of urea and formaldehyde. A glyoxal resin is a polycondensate of formaldehyde and a reaction product of glyoxal and urea.

Inclusion of nitrogen atoms in the thermosetting unit enables the thermosetting unit to perform a function of cross-link curing more effectively. Particularly preferably, the thermosetting unit is at least one unit selected from the group consisting of a unit derived from a monomer or prepolymer of a melamine-based resin, a unit derived from a monomer or prepolymer of a urea-based resin, and a unit derived from a monomer or prepolymer of a glyoxal-based resin. In order that the thermosetting resin has a high reactivity, the amount of nitrogen atoms contained in the thermosetting unit is preferably adjusted to be no less than 40% by mass and no greater than 55% by mass in the case of monomer or prepolymer of a melamine-based resin, approximately 40% by mass in the case of a monomer or prepolymer of a urea-based resin, and approximately 15% by mass in the case of a monomer or prepolymer of glyoxal-based resin.

Examples of the monomer of a thermosetting resin that can be used to include the thermosetting unit in the shell layers include methylol melamine, benzoguanamine, acetoguanamine, spiroguanamine, and dimethylol dihydroxyethyleneurea (DMDHEU).

The shell layers preferably have a thickness of no less than 1 nm and no greater than 20 nm, and more preferably no less than 1 nm and no greater than 10 nm. As a result of the thickness of the shell layers being no greater than 20 nm, the shell layers are readily ruptured, enabling fixing of the toner to a recording medium at low temperatures. Furthermore, as a result of the thickness of the shell layers being no greater than 20 nm, chargeability of the shell layers is expected to be restricted from becoming excessively strong, facilitating appropriate image formation. On the other hand, as a result of the thickness of the shell layers being no less than 1 nm, the shell layers are expected to have sufficient strength. The shell layers are therefore restricted from rupturing on impact (e.g., impact during transportation), and thus preservability of the toner is expected to be improved. The thickness of the shell layers can be measured by analyzing cross-sectional transmission electron microscopy (TEM) images of the toner particles using commercially available image analysis software (e.g., "WinROOF", product of Mitani Corporation). If the thickness of the shell layer is not uniform for a single toner particle, the thickness of the shell layer is measured at each of four locations that are evenly spaced and the arithmetic mean of the four measured values is determined to be an evaluation value (thickness of the shell layer) for the toner particle. More specifically, the four measurement locations are determined by drawing two straight lines that intersect at right angles at approximately the center of the cross-section of the toner particle and by determining four locations at which the two straight lines and the shell layer intersect to be the measurement locations.

The shell layers may have fractures therein (i.e., portions having low mechanical strength). The fractures can be formed by causing localized defects to occur in the shell layers. Formation of the fractures in the shell layers enables the shell layers to be ruptured more readily. As a result, the toner can be fixed to a recording medium at low temperatures. Any appropriate number of fractures may be present in the shell layers.

[External Additive]

An external additive may be caused to adhere to the surfaces of the toner mother particles. The external additive is for example used in order to improve fluidity or handleability of the toner. In order to improve the fluidity or the handleability of the toner, the amount of the external additive is preferably no less than 0.5 parts by mass and no greater than 10 parts by mass relative to 100 parts by mass of the toner mother particles, and more preferably no less than 1.5 parts by mass and no greater than 5 parts by mass. In order to improve the fluidity or the handleability of the toner, the external additive preferably has a particle size of no less than 0.01 μm and no greater than 1.0 μm.

Preferable examples of the external additive include particles of silica or particles of a metal oxide (more specifically, alumina, titanium oxide, magnesium oxide, zinc oxide, strontium titanate, or barium titanate).

[Toner Manufacturing Method]

Next, a toner manufacturing method according to the present embodiment will be described. The toner manufacturing method according to the present embodiment includes preparing cores. Next, at least a material for forming a thermoplastic unit, a material for forming a thermosetting unit, and the cores are added to a liquid. Next, shell layers including a resin containing the thermoplastic unit and the thermosetting unit are formed over surfaces of the cores in the liquid. In order to prepare high-quality cores easily, the cores are preferably prepared by a dry process. In order to form homogeneous shell layers on the surfaces of the cores, the shell layers are preferably formed by a wet process. In order to inhibit dissolution or elution of the core materials (in particular, a binder resin and a releasing agent) during the formation of the shell layers, the formation of the shell layers is preferably carried out in an aqueous medium. In order to form homogeneous shell layers in an aqueous medium, the shell material (a thermoplastic resin relating to the thermoplastic unit and a thermosetting resin relating to the thermosetting unit) is preferably water-soluble. The aqueous medium is a medium mainly containing water (more specifically, purified water, a mixture of water and a polar medium, or the like). The aqueous medium may function as a solvent. A solute may be dissolved in the aqueous medium. The aqueous medium may function as a dispersion medium. A dispersoid may be dispersed in the aqueous medium. Examples of the usable polar medium in the aqueous medium include alcohol (more specifically, methanol, ethanol, or the like).

More specifically, ion exchanged water is prepared as the aforementioned liquid. Next, the pH of the liquid is adjusted using, for example, hydrochloric acid. Next, the shell material (the material for forming the thermoplastic unit and the material for forming the thermosetting unit) is added to the liquid. Thus, the shell material is dissolved or dispersed in the liquid to give a shell material-containing liquid. An appropriate amount of the shell material to be added can be calculated based on the specific surface area of the cores.

Next, the cores are added to the shell material-containing liquid, and the liquid is heated under stirring. The liquid is for example heated up to 70° C. over 30 minutes at a heating rate of 0.5° C./minute to 2° C./minute. As a result, the shell material adheres to the surfaces of the cores and hardens while adhering thereto by undergoing a polymerization reaction. As a result of the above process, a dispersion of toner mother particles is obtained.

If the temperature of the shell material-containing liquid exceeds a glass transition point (Tg) of the cores during the hardening of the shell layers, the cores are likely to deform. For example, in a configuration in which Tg of the binder resin of the cores is 45° C., and the thermosetting unit included in the shell layers is a unit derived from an acrylic acid-based resin, and the thermosetting unit included in the shell layers is a unit derived from a monomer or prepolymer of a melamine resin, heating of the liquid to approximately 50° C. tends to rapidly accelerate a curing reaction of the shell material (particularly, the material for forming the thermosetting unit), causing deformation of the cores. When the shell material is caused to react at high temperatures, the shell layers readily hardened. Heating of the liquid to a higher temperature during the curing of the shell layers tends to accelerate the deformation of the cores, yielding more spherical toner mother particles. Desirably, the temperature of the liquid during the curing of the shell layers is adjusted so as to give a desired shape of the toner mother particles. The molecular weight of the shell layers can be controlled by adjusting the temperature of the liquid during the curing of the shell layers.

After the curing of the shell layers as described above, the dispersion of the toner mother particles is neutralized for example with sodium hydroxide. The solution is subsequently cooled. Once cooled, the solution is filtered. Through the above process, the toner mother particles are separated from the liquid (solid-liquid separation). Next, the toner mother particles that have been separated are washed. Next, the toner mother particles that have been washed are dried. Thereafter, an external additive is attached to the surfaces of the toner mother particles as occasion demands. The above completes the manufacture of a toner containing a large number of toner particles. In a process in which an external additive is not attached to the surfaces of the toner mother particles (external additive addition process is omitted), the toner mother particles are equivalent to the toner particles. Preferably, a large number of the toner particles are formed at the same time in order to manufacture the toner efficiently.

[Examples]

Examples of the present disclosure will be described. Table 1 shows details of toners A-1 to A-3, B-1 to B-7, and C-1 to C-6 (electrostatic latent image developing toners) according to Examples and Comparative Examples.

TABLE 1

| | Encapsulation conditions | | | Toner | | |
|---|---|---|---|---|---|---|
| Toner | Shell material | Heating rate (° C./minute) | Polymerization Temperature (° C.)-Time (minutes) | Average roundness | conjugation rate (% by number) | Toner displacement rate |
| A-1 | A | 0.5 | 65° C.-30 min | 0.970 | 0.3 | 0.55% |
| A-2 | A | 0.5 | 65° C.-30 min | 0.971 | 0.4 | 0.57% |
| A-3 | A | 0.5 | 65° C.-30 min | 0.964 | 0.1 | 0.56% |
| B-1 | A | 0.5 | 65° C.-60 min | 0.976 | 0.6 | 0.32% |
| B-2 | A | 0.5 | 65° C.-90 min | 0.970 | 0.7 | 0.42% |
| B-3 | A | 0.5 | 60° C.-15 min | 0.962 | 0.1 | 0.77% |

TABLE 1-continued

| Toner | Encapsulation conditions: Shell material | Heating rate (° C./minute) | Polymerization Temperature (° C.)-Time (minutes) | Average roundness | Toner: conjugation rate (% by number) | Toner displacement rate |
|---|---|---|---|---|---|---|
| B-4 | A | 0.5 | 60° C.-30 min | 0.966 | 0.1 | 0.63% |
| B-5 | A | 0.5 | 60° C.-45 min | 0.969 | 0.2 | 0.58% |
| B-6 | A | 0.5 | 70° C.-30 min | 0.974 | 0.3 | 0.66% |
| B-7 | A | 0.5 | 70° C.-60 min | 0.978 | 0.8 | 0.25% |
| C-1 | B | 0.5 | 65° C.-30 min | 0.971 | 0.2 | 0.53% |
| C-2 | B | 0.5 | 65° C.-30 min | 0.963 | 0.1 | 0.58% |
| C-3 | C | 0.5 | 65° C.-30 min | 0.970 | 0.3 | 0.57% |
| C-4 | C | 0.5 | 65° C.-30 min | 0.961 | 0.1 | 0.55% |
| C-5 | D | 0.5 | 65° C.-30 min | 0.969 | 0.2 | 0.58% |
| C-6 | D | 0.5 | 65° C.-30 min | 0.962 | 0.1 | 0.59% |

Hereinafter, a preparation method, an evaluation method, and evaluation results for each of the toners A-1 to C-6 will be described in order. In evaluations in which errors may occur, an evaluation value was calculated by calculating the arithmetic mean of an appropriate number of measured values in order to ensure that any errors were sufficiently small.

[Method of Manufacturing Toner A-1]

(Preparation of Cores)

In a method of manufacturing the toner A-1, cores were prepared according to the following procedure. First, 750 g of a low viscosity polyester resin (Tg: 38° C., Tm: 65° C.), 100 g of a medium viscosity polyester resin (Tg: 53° C., Tm: 84° C.), 150 g of a high viscosity polyester resin (Tg: 71° C., Tm: 120° C.), 55 g of a releasing agent, and 40 g of a colorant were mixed at a rotation speed of 2,400 rpm using an FM mixer (product of Nippon Coke & Engineering Co.). The melt viscosity of the binder resin (polyester resin) can be decreased by increasing the proportion of the low viscosity polyester resin in the binder resin (polyester resin).

"KET Blue 111" (Phthalocyanine Blue), product of DIC Corporation, was used for the colorant. "Carnauba Wax No. 1", product of S. Kato & Co., was used for the releasing agent.

Next, the resulting mixture was melt-kneaded using a twin screw extruder ("PCM-30", product of Ikegai Corp.) under conditions of a material addition rate of 5 kg/hour, a shaft rotation speed of 160 rpm, and a temperature range from no less than 80° C. to no greater than 110° C. The resulting melt-knead product was subsequently cooled.

Next, the melt-knead product was roughly pulverized using a mechanical pulverizer ("Rotoplex (registered Japanese trademark) 16/8", product of Hosokawa Micron Corporation). The resulting roughly pulverized product was finely pulverized using a jet mill ("Model-I Super Sonic Jet Mill", product of Nippon Pneumatic Mfg.). The finely pulverized product was subsequently classified using a classifier ("Elbow Jet EJ-LABO Model EJ-LABO, product of Nittetsu Mining Co., Ltd.). As a result, cores having a volume median diameter ($D_{50}$) of 6.0 μm were obtained. The volume median diameter was measured using a "Multisizer 3 COULTER COUNTER", product of Beckman Coulter, Inc.

(Formation of Shell Layers)

A 1-L three-necked flask equipped with a thermometer and a stirring impeller was prepared and placed in a water bath. The inner temperature of the flask was maintained at 30° C. using the water bath. Next, 500 mL of ion exchanged water and 50 g of sodium polyacrylate ("JURYMER (registered Japanese trademark) AC-103", product of Toagosei Co., Ltd.) were added to the flask. As a result, an aqueous sodium polyacrylate solution was obtained in the flask.

Next, 100 g of the cores (powder) prepared as described above were added to the aqueous sodium polyacrylate solution. Next, the contents of the flask were sufficiently stirred at room temperature. As a result, a dispersion of the cores was obtained in the flask.

Next, the dispersion of the cores was filtered using filter paper having a pore size of 3 μm. Next, the cores separated through the filtration were re-dispersed in ion exchanged water. Thereafter, the filtration and the re-dispersion were repeated five times in order to wash the cores. Next, a suspension of 100 g of the cores in 500 mL of ion exchanged water was prepared in a flask.

Next, 1 g of an aqueous solution of methylol urea ("MIRBANE (registered Japanese trademark) resin SU-100", product of Showa Denko K.K., solid concentration: 80% by mass) and 6.9 g of an aqueous solution of an acrylic acid-based resin ("Cogum (registered Japanese trademark) HW-62", product of Showa Denko K.K., solid concentration: 14.5% by mass) were added to the flask. Next, the suspension in the flask was adjusted to pH 4 through addition of dilute hydrochloric acid to the flask.

After the pH adjustment, the suspension was transferred to a 1-L separable flask. Next, the inner temperature of the flask was raised up to 65° C. (polymerization temperature) at a heating rate of 0.5° C./minute while the contents of the flask were stirred at a rotational speed of 100 rpm. The inner temperature of the flask was then maintained at 65° C. (polymerization temperature) for 30 minutes (polymerization time) while the contents of the flask were stirred at a rotational speed of 150 rpm (stirring rate during a polymerization reaction). With the inner temperature of the flask maintained at a high temperature (65° C.), the shell material underwent the polymerization reaction, and the cores and the shell material were reacted with one another, forming shell layers including a resin containing the thermoplastic unit and the thermosetting unit over the surfaces of the cores. As a result, a dispersion of toner mother particles was obtained. Next, the dispersion of the toner mother particles was cooled to room temperature and adjusted to pH 7 (neutralized) with sodium hydroxide.

(Washing and Drying of Toner Mother Particles)

The dispersion of the toner mother particles obtained as described above was subjected to filtration (solid-liquid separation) to collect the toner mother particles. Next, the toner mother particles collected were re-dispersed in ion exchanged water. The toner mother particles were washed by repeating steps of filtration and dispersion. The toner mother particles were subsequently dried.

(External Addition)

External addition was performed on the toner mother particles after the drying described above. An external additive (silica particles) was attached to the surfaces of the toner mother particles by mixing 100 parts by mass of the toner mother particles and 1.5 parts by mass of dry silica fine particles ("REA90", product of Nippon Aerosil Co., Ltd.). Thus, the toner A-1 containing a large number of toner particles was manufactured.

[Method of Manufacturing Toner A-2]

The toner A-2 was manufactured in the same manner as in the manufacture of the toner A-1 except that the stirring rate during the polymerization reaction for forming shell layers was changed from 150 rpm to 140 rpm.

[Method of Manufacturing Toner A-3]

The toner A-3 was manufactured in the same manner as in the manufacture of the toner A-1 except that the stirring rate during the polymerization reaction for forming shell layers was changed from 150 rpm to 130 rpm.

[Method of Manufacturing Toner B-1]

The toner B-1 was manufactured in the same manner as in the manufacture of the toner A-1 except that the polymerization time was changed from 30 minutes to 60 minutes.

[Method of Manufacturing Toner B-2]

The toner B-2 was manufactured in the same manner as in the manufacture of the toner A-1 except that the polymerization time was changed from 30 minutes to 90 minutes.

[Method of Manufacturing Toner B-3]

The toner B-3 was manufactured in the same manner as in the manufacture of the toner A-1 except that the polymerization temperature was changed from 65° C. to 60° C. and the polymerization time was changed from 30 minutes to 15 minutes.

[Method of Manufacturing Toner B-4]

The toner B-4 was manufactured in the same manner as in the manufacture of the toner A-1 except that the polymerization temperature was changed from 65° C. to 60° C.

[Method of Manufacturing Toner B-5]

The toner B-5 was manufactured in the same manner as in the manufacture of the toner A-1 except that the polymerization temperature was changed from 65° C. to 60° C. and the polymerization time was changed from 30 minutes to 45 minutes.

[Method of Manufacturing Toner B-6]

The toner B-6 was manufactured in the same manner as in the manufacture of the toner A-1 except that the polymerization temperature was changed from 65° C. to 70° C.

[Method of Manufacturing Toner B-7]

The toner B-7 was manufactured in the same manner as in the manufacture of the toner A-1 except that the polymerization temperature was changed from 65° C. to 70° C. and the polymerization time was changed from 30 minutes to 60 minutes.

[Method of Manufacturing Toner C-1]

The toner C-1 was manufactured in the same manner as in the manufacture of the toner A-1 except that 6.9 g of an aqueous solution of an acrylic acid-based resin ("Cogum HW-750", product of Showa Denko K.K., solid concentration: 14.5% by mass) was used instead of 6.9 g of "Cogum HW-62", product of Showa Denko K.K.

[Method of Manufacturing Toner C-2]

The toner C-2 was manufactured in the same manner as in the manufacture of the toner C-1 except that the stirring rate during the polymerization reaction for forming shell layers was changed from 150 rpm to 130 rpm.

[Method of Manufacturing Toner C-3]

The toner C-3 was manufactured in the same manner as in the manufacture of the toner A-1 except that 1 g of water-soluble methylol melamine ("Nikaresin (registered Japanese trademark) S-176", product of NIPPON CARBIDE INDUSTRIES CO. INC.) was used instead of 1 g of "MIRBANE resin SU-100", product of Showa Denko K.K.

[Method of Manufacturing Toner C-4]

The toner C-4 was manufactured in the same manner as in the manufacture of the toner C-3 except that the stirring rate during the polymerization reaction for forming shell layers was changed from 150 rpm to 130 rpm.

[Method of Manufacturing Toner C-5]

The toner C-5 was manufactured in the same manner as in the manufacture of the toner A-1 except that 1 g of water-soluble methylol melamine ("Nikaresin (registered Japanese trademark) S-260", product of NIPPON CARBIDE INDUSTRIES CO. INC.) was used instead of 1 g of "MIRBANE resin SU-100", product of Showa Denko K.K.

[Method of Manufacturing Toner C-6]

The toner C-6 was manufactured in the same manner as in the manufacture of the toner C-5 except that the stirring rate during the polymerization reaction for forming shell layers was changed from 150 rpm to 130 rpm.

[Evaluation Methods]

Each of the samples (toners A-1 to C-6) was evaluated as follows.

(Average Roundness)

The roundness of a sample (toner) was measured using a flow particle imaging analyzer ("FPIA (registered Japanese trademark) 3000", product of Sysmex Corporation). More specifically, the roundness of each of 3,000 toner particles contained in the sample (toner) was measured, and an average of the 3,000 roundness values obtained was determined to be an evaluation value.

(Toner Conjugation Rate)

An image of a sample (toner) was captured using a flow particle imaging analyzer ("FPIA 3000", product of Sysmex Corporation). The proportion of toner particles having a roundness of no greater than 0.85 in the sample (toner) (hereinafter, referred to as a toner conjugation rate) was determined based on the image captured. More specifically, each of 3,000 toner particles included in the sample (toner) was determined as to whether or not the roundness thereof was no greater than 0.85, and the number of the toner particles having a roundness of no greater than 0.85 (hereinafter, referred to as conjugated particles) was counted. A toner conjugation rate (unit: % by number) was determined in accordance with the following equation.

$$\text{Toner conjugation rate} = 100 \times \text{number of conjugated particles}/3{,}000$$

(Toner Displacement Rate)

A micro-compression test was performed on a sample (toner) using a scanning probe station ("NanoNaviReal", product of Hitachi High-Tech Science Corporation) equipped with a scanning probe microscope (SPM) ("multifunctional unit AFM5200S", product of Hitachi High-Tech Science Corporation). The maximum load was set to 60 nN in the SPM, and the toner particles (specifically, shell layers) contained in the sample (toner) were subjected to load at a load rate of 60 nN/s in an environment at a temperature of 23° C. and a relative humidity of 50%. An amount of displacement (hereinafter, referred to as displacement amount Z1) of the toner particles was measured at 1 second after the load reached the maximum (60 nN). In addition, the particle size (equivalent spherical diameter) of each of the toner particles subjected to load was measured using "Coulter Counter Multisizer 3", product of Beckman Coulter, Inc. Hereinafter, the particle size (equivalent spherical diameter) of each toner particle thus measured is referred to as a particle size Z2. A toner displacement rate (%) represented by 100×displacement amount Z1/particle size Z2" of each of 10 toner particles included in the sample (toner) was calculated based on the displacement amount Z1 and the particle size Z2 measured as described above. An arithmetic mean of the 10 measurement values was determined to be an evaluation value of the sample (toner).

(High-Temperature Preservability)

A polyethylene container having a capacity of 20 mL was filled with 3 g of a sample (toner) and then sealed. The sealed container was left to stand for 3 hours in a thermostatic chamber ("DKN302" soled by Yamato Scientific Co., Ltd.) set to 55° C. The toner was then taken out from the thermostatic chamber and cooled to room temperature to give an evaluation toner.

The evaluation toner was subsequently placed on a 200-mesh sieve whose mass is known. The mass of the toner prior to sifting was calculated by measuring the total mass of the sieve and the evaluation toner thereon. Next, the sieve was placed in a powder tester (product of Hosokawa Micron Corporation) and the evaluation toner was sifted in accordance with a manual of the powder tester by shaking the sieve for 30 seconds at a rheostat level of 4. After the sifting, the mass of the toner that passed through the sieve was measured. Based on the mass of the toner before the sifting and the mass of the toner that passed through the sieve, a toner passage rate (unit: % by mass) was determined in accordance with the following equation.

Toner passage rate=100×mass of toner that passed through sieve/mass of toner before sifting A toner passage rate of no less than 80% by mass was evaluated as G (good), and a toner passage rate of less than 80% by mass was evaluated as B (bad).

(Charge, Fixability, Image Density, and Blade Cleaning Ability)

A two-component developer was prepared by mixing 100 parts by mass of a developer carrier (carrier for FS-05300DN) and 10 parts by mass of a sample (toner) for 30 minutes using a ball mill. The resulting two-component developer was left to stand for 24 hours in an environment at a temperature of 20° C. and a relative humidity of 65%. Next, a charge of the toner in the two-component developer was measured in the environment (temperature: 20° C., relative humidity: 65%) using a Q/m meter ("MODEL 210HS", product of TREK, INC.). More specifically, only the sample (toner) in 0.10 g (±0.01 g) of the developer was drawn in using a suction section of the Q/m meter. Next, a charge of the sample (toner) was calculated based on the amount of drawn-in sample (toner) and the displayed result (amount of charge) of the Q/m meter. A charge of the toner of no less than 25 μC/g and no greater than 35 μC/g was evaluated as G (good), and a charge of the toner of less than 25 μC/g or greater than 35 μC/g was evaluated as B (bad).

An image was formed using the two-component developer prepared as described above, and fixability, image density, and blade cleaning ability were evaluated for the developer. The evaluation was performed using a color printer ("FS-05300DN", product of KYOCERA Document Solutions Inc., modified to enable adjustment of fixing temperature) having a roller-roller type heat-pressure fixing section as an evaluation device. The two-component developer prepared as described above was loaded into a developing section of the evaluation device and a sample (toner for replenishment use) was loaded into a toner container of the evaluation device.

Hereinafter, a method of evaluating fixability of a sample (toner) will be described. A solid image having a size of 25 mm×25 mm and a coverage of 100% was formed on 90 g/m$^2$ paper (printing paper) using the evaluation device at a toner application amount of 1.0 mg/cm$^2$ for the evaluation of the fixability of the sample (toner). Next, the paper on which the image has been formed was passed through the fixing section. The fixing temperature was set within a range from 145° C. to 170° C. More specifically, the fixing temperature of the fixing section was increased from 145° C. in increments of 5° C., and whether or not offset occurred in the image fixed (whether or not the toner adhered to the fixing rollers) was observed at each temperature. It was evaluated to be G (good) if offset was not observed and B (bad) if offset was observed.

Hereinafter, a method of evaluating the image density of an image formed using a sample (toner) will be described. For the evaluation of image density, a sample image including a solid section was printed on paper (printing paper) using the evaluation device in an environment at a temperature of 23° C. and a relative humidity of 50%, and the image density (ID) of the solid section in the sample image formed on the paper was measured. The image density was measured using a reflectance densitometer ("RD914, product of X-Rite Inc.).

The image density of an image printed on an initial-stage sheet (the fifth sheet) (hereinafter, referred to as a first image) and the image density of an image printed on the 500th sheet in successive 500-sheet printing (hereinafter, referred to as a second image) were measured as described above. The lowest image density measurement value of the image density of the first image and the image density of the second image was determined to be an evaluation value of the sample (toner). An image density of no less than 1.2 was devalued as G (good), and an image density of less than 1.2 was evaluated as B (bad).

Hereinafter, a method of evaluating blade cleaning ability of a sample (toner) will be described. For the evaluation of the blade cleaning ability of a sample (toner), an evaluation image having a coverage of 100% was printed on successive 1,000 sheets of paper (printing paper) using the evaluation device, and the presence or absence of blotches (e.g., veined pattern) was observed visually on the lastly printed sheet. It was evaluated to be G (good) if no blotches were observed and B (bad) if blotches were observed. Insufficient blade cleaning ability at a photosensitive drum may lead to generation of a veined pattern on an image that is formed.

[Evaluation Results]

Evaluation results of each of the toners A-1 to C-6 are as follows. Table 2 shows results of the evaluations of the charge, the high-temperature preservability, the image density, the fixability, and the blade cleaning ability. Results of the evaluations of the average roundness, the toner conjugation rate, and the toner displacement rate are shown in Table 1.

TABLE 2

| | Toner | Charge (μC/g) | Preservability (wt %) | Image density | Fixability (Offset resistance evaluation) 145° C. | 150° C. | 155° C. | 160° C. | 165° C. | 170° C. | Cleaning ability |
|---|---|---|---|---|---|---|---|---|---|---|---|
| Example 1 | A-1 | 28 | 88 | 1.25 | G | G | G | G | G | G | G |
| Example 2 | A-2 | 29 | 86 | 1.27 | G | G | G | G | G | G | G |
| Example 3 | B-4 | 27 | 95 | 1.29 | G | G | G | G | G | G | G |
| Example 4 | B-5 | 28 | 90 | 1.25 | G | G | G | G | G | G | G |
| Example 5 | B-6 | 31 | 83 | 1.21 | G | G | G | G | G | G | G |
| Example 6 | C-1 | 27 | 90 | 1.22 | G | G | G | G | G | G | G |
| Example 7 | C-3 | 29 | 88 | 1.25 | G | G | G | G | G | G | G |
| Example 8 | C-5 | 28 | 87 | 1.24 | G | G | G | G | G | G | G |
| Comparative Example 1 | A-3 | 25 | 77 | 1.30 | B | G | G | G | G | G | B |
| Comparative Example 2 | B-1 | 33 | 90 | 1.21 | G | G | G | G | G | G | B |
| Comparative Example 3 | B-2 | 33 | 92 | 1.23 | B | G | G | G | G | G | B |
| Comparative Example 4 | B-3 | 24 | 75 | 1.31 | B | G | G | G | G | G | G |
| Comparative Example 5 | B-7 | 34 | 91 | 1.20 | G | G | G | G | G | G | B |
| Comparative Example 6 | C-2 | 26 | 78 | 1.30 | B | G | G | G | G | G | B |
| Comparative Example 7 | C-4 | 27 | 81 | 1.30 | G | G | G | G | G | B | B |
| Comparative Example 8 | C-6 | 28 | 82 | 1.30 | G | G | G | G | G | B | B |

The toners A-1, A-2, B-4, B-5, B-6, C-1, C-3, and C-5 (toners according to Examples 1 to 8) each satisfied the above-mentioned conditions (1) to (4). More specifically, the toners according to Examples 1 to 8 each had shell layers including a resin containing a unit derived from an acrylic acid-based resin and a unit derived from a monomer or prepolymer of a urea-based resin (or a melamine-based resin). At the same time, the toners according to Examples 1 to 8 each had an average roundness of no less than 0.965 and no greater than 0.975. At the same time, the toners according to Examples 1 to 8 each contained conjugated particles (toner particles having a roundness of no greater than 0.85) in an amount (toner conjugation rate) of less than 0.5% by number. At the same time, the toners according to Examples 1 to 8 each had a toner displacement rate of no less than 0.50% and no greater than 0.70%. As indicated by Table 2, the toners according to Examples 1 to 8 were excellent in high-temperature preservability, fixability, and blade cleaning ability. Furthermore, the toners according to Examples 1 to 8 each achieved an image density of no less than 1.2 and a charge of no less than 25 μC/g and no greater than 35 μC/g.

The toners A-1, B-4, and B-5 (toners according to Examples 1, 3, and 4) each had shell layers including a resin containing a unit derived from an acrylic acid-based resin and a unit derived from a monomer or prepolymer of a urea-based resin, and had an average roundness of no less than 0.965 and no greater than 0.970. The toners satisfying such conditions were excellent particularly in high-temperature preservability.

It is thought that the slower the heating rate in the capsulation (shell layer formation), the more likely cores or toner mother particles are to form conjugates (irregular-shaped particles). It is also thought that the longer the polymerization time (time during which the polymerization temperature is maintained) in the capsulation, the higher the average roundness of toner particles.

What is claimed is:

1. A toner comprising a plurality of toner particles each including a core and a shell layer disposed over a surface of the core, wherein the shell layers include a resin containing a unit derived from a thermoplastic resin and a unit derived from a monomer or prepolymer of a thermosetting resin, the toner has an average roundness of no less than 0.965 and no greater than 0.975, the toner contains less than 0.5% by number of toner particles having a roundness of no greater than 0.85, the toner has a displacement rate represented by the equation "toner displacement rate=100×Z1/Z2" of no less than 0.50% and no greater than 0.70% as measured in a micro-compression test on the toner, where: Z1 is an amount of displacement of the toner particles when subjected to load at a load rate of 60 nN/s until the load reaches a maximum load of 60 nN, and then left to stand for one second at the maximum load in an environment at a temperature of 23° C. and a relative humidity of 50%; and Z2 is a particle size of the toner particles, the cores contain a polyester resin, the unit derived from a thermoplastic resin is cross-linked by the unit derived from a monomer or prepolymer of a thermosetting resin in the shell layer, and the resin included in the shell layers contains, as the unit derived from a monomer or prepolymer of a thermosetting resin, one or more units selected from the group consisting of a unit derived from a monomer or prepolymer of a melamine-based resin, a unit derived from a monomer or prepolymer of a urea-based resin, and a unit derived from a monomer or prepolymer of a glyoxal-based resin.

2. The toner according to claim 1, wherein the toner contains no greater than 0.3% by number of toner particles having a roundness of no greater than 0.85.

3. The toner according to claim 1, wherein the shell layers include a resin containing a unit derived from an acrylic acid-based resin and a unit derived from a monomer or prepolymer of a urea-based resin, and the toner has an average roundness of no less than 0.965 and no greater than 0.970.

4. The toner according to claim 1, wherein the thermoplastic resin and the thermosetting resin are water-soluble.

5. The toner according to claim 1, wherein the cores are prepared through a dry process, and the shell layers are formed through a wet process.

6. The toner according to claim 1, wherein the shell layers have a thickness of no less than 1 nm and no greater than 20 nm.

* * * * *